United States Patent [19]

Janis

[11] 4,138,107

[45] Feb. 6, 1979

[54] SPORTS TETHERED BALL PRACTICE DEVICE

[76] Inventor: Zbig Janis, 334 Riverside Dr., New York, N.Y. 10025

[21] Appl. No.: 781,120

[22] Filed: Mar. 25, 1977

[51] Int. Cl.[2] ..... A63B 69/38

[52] U.S. Cl. ..... 273/29 A; 273/26 E

[58] Field of Search ..... 273/29 A, 26 A, 26 E, 273/26 EA, 95 A, 58 C, 55 R

[56] References Cited

U.S. PATENT DOCUMENTS

| | | | |
|---|---|---|---|
| 2,153,384 | 4/1939 | Mazza | 273/55 R |
| 2,247,072 | 6/1941 | Stow | 273/29 A |
| 3,114,549 | 12/1963 | Kooker | 273/55 R |
| 3,630,521 | 12/1971 | Lingbeek | 273/26 EA |

*Primary Examiner*—William H. Grieb

*Assistant Examiner*—T. Brown

*Attorney, Agent, or Firm*—Amster, Rothstein & Engelberg

[57] ABSTRACT

A sports practice device for practicing the stroking motion used in games such as tennis, baseball, squash and the like includes a pair of guide rails mounted to the floor and ceiling of a room, a pair of carriages constrained to move relative to the rails between stops mounted in the rails, and a ball secured to an elastic cord which in turn is secured to the carriage members thereby suspending the ball a pre-determined distance above the floor at a hitting position. When the ball is hit, motion is imparted to the carriage members which move along the guide rails until their motion is stopped by the stops. The ball continues to move stretching the elastic cord which after full stretch snaps the ball back to its initial position.

5 Claims, 7 Drawing Figures

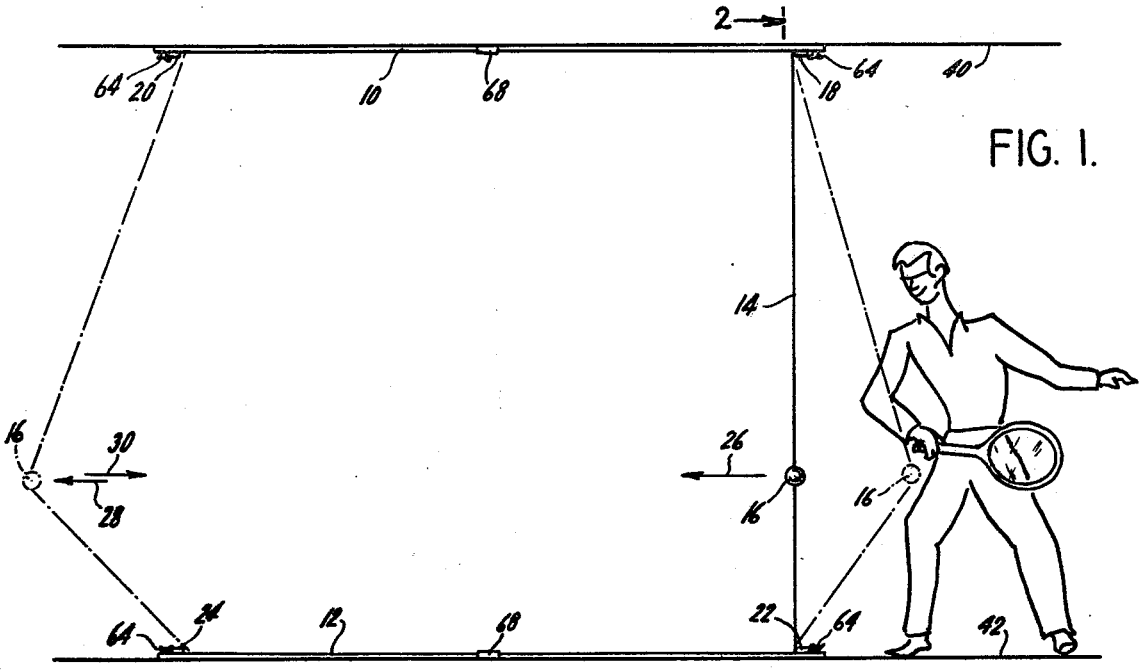
FIG. 1.
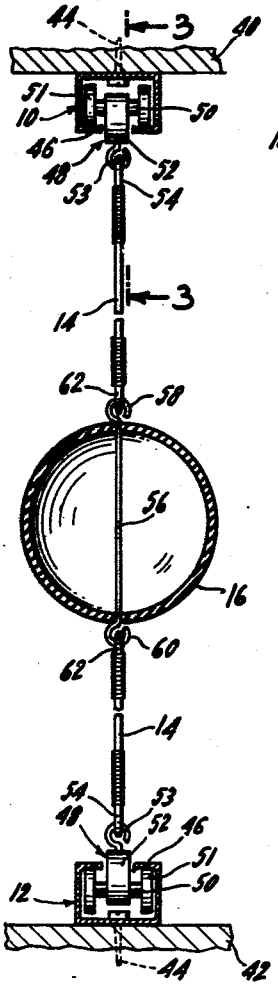
FIG. 2.
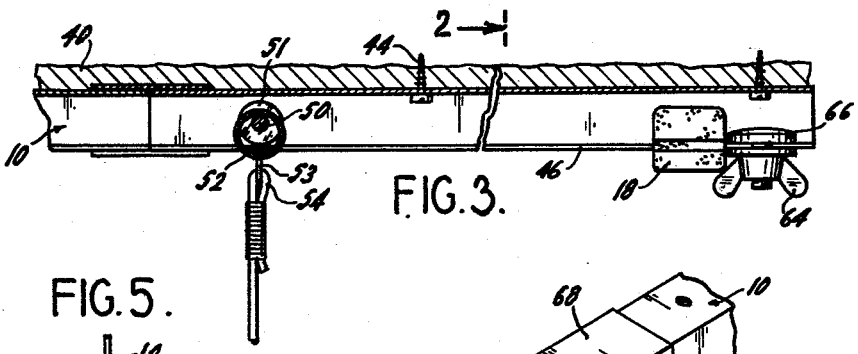
FIG. 3.
FIG. 5.
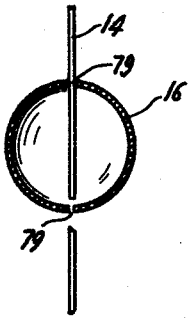
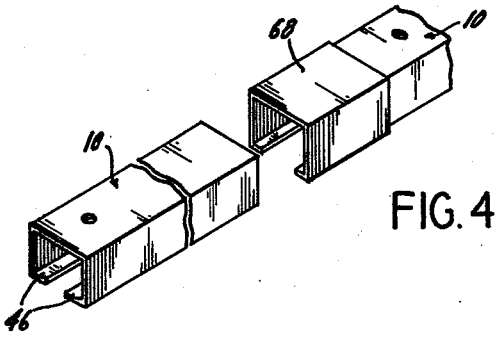
FIG. 4.
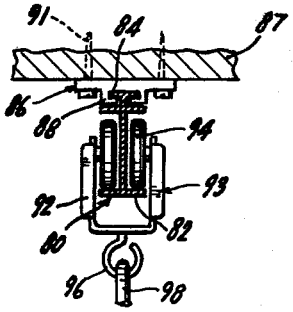
FIG. 7.
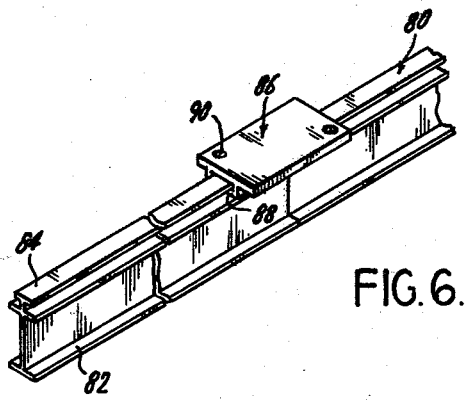
FIG. 6.

SPORTS TETHERED BALL PRACTICE DEVICE

The invention relates to sports devices and in particular to sports devices for practicing the stroking motion used to hit a ball in such games as tennis, paddle ball, squash, baseball and the like.

Many sports practices devices of the general type have been proposed. One such device, described in U.S. Pat. No. 3,630,521 issued Dec. 28, 1971, to Lingbook et al, includes a pair of horizontally spaced apart floor mounted posts, a pair of horizontally extending vertically spaced apart arms extending from one of the posts, a pair of vertically spaced flexible wires stretched between the posts and extending through the arms, an elastic cord, a ball slidably disposed on the elastic cord and rings attached to the opposite ends of the elastic cord which slidably engage the flexible wires. When the ball is struck, for example with a bat for baseball batting practice, the ball is propelled forward carrying the elastic cord along the horizontal wires until the rings hit the arms. The ball, however, continues its forward motion stretching the elastic cord which then snaps the ball back toward the batter. There are a number of problems which occur with the use of this practice device. In particular, the use of rings sliding on a wire permits the ball to travel in a relatively uncontrolled manner. Further, after the ball is hit, it will slide relative to the elastic cord. It is therefore difficult if not impossible to repeatedly practice a single stroke since the ball returns to the hitter at a different point after each stroke. In addition, the arms must extend from the support a sufficient distance to permit full stretch of the cord without the ball striking the support so that the device has a relatively large end section. Also the arms interfere with the stroke requiring that the device be used from only one end. The vertical supports also interfere with and restrict the practice stroke.

It is therefore an object of the invention to overcome these and other problems in the prior act and to provide an improved practice device.

It is another object of the invention to provide a sports practice device in which the motion of the ball is controlled after it is hit.

It is another object of the invention to provide a practice device which is free of any vertical obstructions adjacent at least to one end thereby providing space for free access to the ball.

It is still another object of the invention to provide a sports practice device which is easy to install and usable in a confined space.

In accordance with the invention a sports practice device includes first and second parallel, vertically spaced apart, rigid guide rails, preferably mounted to the floor and ceiling of a room, stop members mounted in opposite ends of each rail, a carriage mounted in each guide rail and constrained to move therein, a ball, and an elastic cord member. The ball is secured to the elastic cord member which in turn is fixed to the carriages to suspend the ball at an appropriate height above the floor. When the ball is struck during practice, a forward motion is imparted to the ball and carriages, which carriages move along the guide rails until the motion is stopped by the stops. The ball continues to move stretching the elastic cord which after full stretch of the elastic cord snaps the ball back. The carriages move along the guide rails returning the ball to the hitting position. With this system of controlled movement, the ball travels horizontally and there is sufficient time between the stroke and the return of the ball to permit the player to rest himself for the next stroke.

These and other objects and features of the invention will be apparent to those skilled in the art from the following description taken in conjunction with the drawings, wherein:

FIG. 1 is a side view of the sports practice device showing the device adapted for use in practicing a tennis backhand stroke;

FIG. 2 is an enlarged sectional view taken along the line 2—2 of FIG. 2 and looking in the direction of the arrows showing guide rails, carriage assembly and elastic cord suspending a ball above the floor;

FIG. 3 is a partial sectional view taken along line 3—3 of FIG. 2 and looking in the direction of the arrows and showing a guide rail and stop member;

FIG. 4 is an isometric partial view of the guide rail of FIG. 1 and particularly showing the way in which two guide rail sections are coupled together;

FIG. 5 is a partial sectional view taken through the ball and illustrating another way to secure the ball to the elastic cord;

FIG. 6 is an isometric view similar to FIG. 4 showing another embodiment of the guide rail;

FIG. 7 is a detail view in section showing a carriage usable with the guide rail of FIG. 6.

Although the sports practice device of the invention can be used to improve the stroking motion for many games, it will now be described, by way of illustration, used for the game of tennis.

Referring to FIG. 1, the sports practice device includes upper rail 10, attached to the ceiling of a room and lower rail 12, attached to the floor of the room. An elastic cord 14, in tension, suspends ball 16 between the upper and lower rails at an appropriate height above the floor. As will be described in greater detail below, the height of ball 16 is adjustable and as shown in FIG. 1 the height of ball 16 has been adjusted to permit player to practice the backhand tennis stroke. The opposite ends of elastic cord 14 are attached to carriages 48 which ride in rails 10, 12 and which are shown in detail in the other figures and discussed in detail below. Rubber stops 18, 20, 22 and 24, positioned at opposite ends of the rails, stop the movement of the carriages when the carriages reach the end of the rails. To use the practice device, a player stands at a hitting station such as the right hand end of the rails and positions himself to strike the ball. When the ball is struck, the ball moves horizontally in the direction of arrow 26 carrying cord 14 and the carriages 48 along rails 10 and 12. During travel, the ball and cord move in vertical alignment. When the carriages 48 reach the opposite ends of the rails, their motion is stopped by stops 20, 24. However the momentum of ball 16 carries the ball further as represented by arrow 28, stretching cord 14 to the dash line position shown at the left. When the ball comes to rest, cord 14 imparts the reverse motion to the ball causing it to move horizontally in the direction of arrow 30 to return to the hitting station. Depending on the force of the initial stroke, the ball may overshoot the hitting station upon its return, as indicated by the dashed line position on the right. The use of the rails and carriages riding in the rails produces essentially only horizontal movement of the ball. Thus the player is assured that the ball will return to the same position from which it started and he can therefore concentrate on perfecting the stroke without having to be concerned with hitting a wildly moving ball and can repeatedly hit the ball upon its return. Practice involving a repetition of the same stroke, over and over again, with the same condition each time will rapidly improve the player's strokes.

Referring to FIG. 2, upper and lower rails 10, 12 are C-shaped cross section with support shoulders 46 and mounted to ceiling 40 and floor 42 by suitable attachment devices such as screws 44. Carriages 48, which are preferably of similar construction, include a yoke 50 to which wheels 51 are attached. Hook 53 extends from the carriages and receives the looped ends 54 of cord 14. Ball 16 is preferably a hard tennis ball, that term generally referring to a non-pressurized tennis ball whose bounce and resiliency is determined by the construction and material of the walls of the ball. Support rod 56 extends through the center of ball 16 and has hooks 58, 60 at its opposite ends which receive looped ends 62 of cord 14.

The height of ball 16 above the floor can be readily changed by changing the relative lengths of the sections of cord 14. The relaxed total length of cord 14 is adjusted to be less than the distance between the upper and lower rails 10, 12 to place cord 14 under tension thereby creating positive engagement between wheels 51 of the carriage and shoulder 46 of the rails. The positive pressure creates a smoother side for the carriage along the track resulting in faster and smoother travel of the ball after it is hit which also maintains the motion of the ball in a substantially horizontal direction.

A typical rubber stop 18 is shown in FIG. 3 mounted to rail 10 and held in place by wing nut 64 and grommets 66. The other stops are similarly held in place. The position of the stops 18 can readily be changed by repositioning grommets 66. The rails can be manufactured in sections, typically three to four feet long and coupled together with appropriate C-shaped couplers 68, shown in detail FIG. 4 and complementary to the size of the rails 10, 12, to construct rails of any desired length.

FIG. 5 is a partial view showing another way of attaching elastic cord 14 to ball 16. In this mode of attachment, holes 80 having a diameter small than the diameter of cord 14 are formed in ball 16. The cord 14 is forced through the hole and the material forming the walls of the ball 16 close down and pinch the cord to hold the ball in place. The height of the ball can be easily adjusted by sliding the ball relative to the cord, however, the pinching effect of the ball on the cord is sufficient to maintain the ball at a fixed vertical position during play.

FIGS. 6 and 7 show another embodiment of a rail and carriage for use in the sports device. Rail 80 is a composite of an I-beam 82 and a T-beam 84. Mounting bracket 86 has a C-shaped holding member 88 which receives the T-beam 84 and holes 90 which permit the bracket 86 to be mounted to a support, such as ceiling 88, by screws 90. Two rail sections are coupled by the holding member as shown in FIG. 6. With this arrangement, the rails can be readily set up for use by sliding into the prepositioned bracket 86 and sliding out of the bracket and stored in an appropriate place when not in use.

Carriage 90, FIG. 7, has an upwardly extending U-shaped yoke 92 and a pair of wheels 94 mounted on the inside faces of the two arms of the yoke. The wheels 94 are spaced apart and sized to ride on the lower flange of the I-beam 82 with the main vertical member of the I-beam 82 between the two wheels. The carriage further includes a hook 96 extending from the yoke 92 which receives the looped end 98 of elastic cord 14, practically shown in FIG. 7. It should be apparent that rails 80 and carriage 90 can be substituted for rails 10 and 12 and carriage 48 of FIGS. 1–3 and the practice device will function as has already been described.

These and other changes and modifications can be made within the spirit and scope of the invention which is set forth in the following claims. For example, the serve stroke in tennis can be practiced by suspending a ball from a carriage mounted in the upper rail.

What I claim is:

1. A tennis practice device, comprising first and second rigid guide rails mounted in parallel to upper and lower vertically spaced-apart support members respectively, first and second wheeled carriage means mounted respectively for movement along said first and second rigid guide rails, a ball, an elastic cord member, means for mounting said ball intermediate the ends of said cord member, said elastic cord member having one of its ends attached to said first wheeled carriage means and its other end attached to said second wheeled carriage means, said elastic cord member being under tension prior to said ball being hit by a player, said ball being supported by said cord member at a selected vertical location between said rigid guide rails for movement in a direction substantially to said rigid guide rails under guidance of said cord member and said wheeled carriage means, and stop means mounted at a pre-determined position in said first and second rigid guide rails and arranged to stop the forward motion of said wheeled carriages imparted thereto by a force exerted on said ball, said tennis practice device having an open space for free access to said ball to permit stroking said ball with proper timing.

2. The tennis practice device of claim 1 wherein said rigid guide rails are formed with C-shaped cross-section.

3. The tennis practice device of claim 1 wherein said wheeled carriages include a yoke and a pair of wheels mounted on said yoke and adapted to ride on said rigid guide rails.

4. The tennis practice device of claim 1 wherein said rigid guide rails are formed with a first I-beam section and a second T-beam section fixed to said I-beam section.

5. In a tennis practice device, the combination of first and second rigid guide rails, said guide rail having means adapted to mount said rails in parallel to respective upper and lower spaced apart support members, first and second wheeled carriages having means adapted to mount the wheel thereof for movement along said rigid guide rails, a ball, an elastic cord member, means adapted to mount said ball intermediate the ends of said cord member, said elastic cord member having one of its ends attached to said first wheeled carriage, and its other end attached to said second carriage, said elastic cord member being under tension prior to said ball being hit by a player, stop members adapted to be mounted at spaced apart positions in said rigid guide rails for stopping said carriages, said rigid guide rails, wheeled carriages, cord members, ball and stop members all being adapted to be arranged to provide a tennis practice device in which the ball is suspended at a pre-determined vertical position between the rigid guide rails with the elastic cord member secured between the wheeled carriages which are constrained to move along the rigid guide rails between the stop members in response to a player hitting the ball, said tennis practice device being free of any vertical obstruction adjacent to at least one end thereof providing open space for free access to said ball to permit stroking said ball with proper timing.

* * * * *